US009447980B2

(12) United States Patent
Masui et al.

(10) Patent No.: US 9,447,980 B2
(45) Date of Patent: Sep. 20, 2016

(54) OUTDOOR UNIT OF REFRIGERATION APPARATUS

(71) Applicant: DAIKIN INDUSTRIES, LTD., Osaka-shi, Osaka (JP)

(72) Inventors: Tomohiro Masui, Sakai (JP); Masashi Kuroishi, Sakai (JP); Takuya Kazusa, Sakai (JP); Junichi Hamadate, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/377,455

(22) PCT Filed: Feb. 5, 2013

(86) PCT No.: PCT/JP2013/052594

§ 371 (c)(1),
(2) Date: Aug. 7, 2014

(87) PCT Pub. No.: WO2013/121933

PCT Pub. Date: Aug. 22, 2013

(65) Prior Publication Data

US 2015/0007605 A1 Jan. 8, 2015

(30) Foreign Application Priority Data

Feb. 13, 2012 (JP) ..... 2012-028387

(51) Int. Cl.
*F28D 1/053* (2006.01)
*F28F 9/00* (2006.01)
(Continued)

(52) U.S. Cl.
CPC . *F24F 1/16* (2013.01); *F24F 1/18* (2013.01); *F25B 39/00* (2013.01);
(Continued)

(58) Field of Classification Search
CPC ..... F28D 1/05308; F28D 1/05333; F28D 1/0535; F28D 1/05358; F28D 1/05383; F28F 9/00; F28F 9/005; F28F 9/001; F24F 1/56; F24F 1/58; B60H 1/32; B60H 1/00524; B60H 1/00521; B60H 1/00542; B60H 1/00535
See application file for complete search history.

(56) References Cited

U.S. PATENT DOCUMENTS 4,305,459 A * 12/1981 Nonnenmann ..... F28F 9/0226 165/173
5,195,579 A * 3/1993 Buchanan ..... F28F 9/0224 165/149

(Continued)

FOREIGN PATENT DOCUMENTS

JP 60-32681 U 3/1985
JP 6-18014 U 3/1994

(Continued)

OTHER PUBLICATIONS

International Search Report of corresponding PCT Application No. PCT/JP2013/052594 dated May 14, 2013.
(Continued)

*Primary Examiner* — Frantz Jules
*Assistant Examiner* — Erik Mendoza-Wilkenfe
(74) *Attorney, Agent, or Firm* — Global IP Counselors

(57) ABSTRACT

An outdoor unit of a refrigeration apparatus includes a heat exchanger, a casing constituent member and a seal member. The heat exchanger has plural collection header pipes, plural fins disposed at a predetermined fin pitch between the header pipes, and plural heat transfer tubes inserted through the fins and connected to the header pipes. An interstice larger than the fin pitch is formed between one of the header pipes and one of the fins adjacent to the one of the header pipes. The casing constituent member is disposed facing the one of the header pipes and is configured to surround part of the heat exchanger. The seal member is attached to the casing constituent member, is pressed against the one of the header pipes and the one of the fins in the environ of the interstice facing the casing constituent members, becomes deformed, and closes the interstice.

20 Claims, 12 Drawing Sheets

(51) Int. Cl.

| | |
|---|---|
| ***F24F 1/56*** | (2011.01) |
| ***F24F 1/28*** | (2011.01) |
| ***F24F 1/16*** | (2011.01) |
| ***F25B 39/00*** | (2006.01) |
| ***F24F 1/18*** | (2011.01) |
| ***F28F 1/12*** | (2006.01) |
| ***F28F 13/00*** | (2006.01) |
| ***F28F 19/00*** | (2006.01) |
| ***F28F 1/32*** | (2006.01) |
| *F25B 13/00* | (2006.01) |

(52) U.S. Cl.

CPC ..... *F28D 1/05308* (2013.01); *F28D 1/05391* (2013.01); *F28F 1/128* (2013.01); *F28F 1/32* (2013.01); *F28F 13/00* (2013.01); *F28F 19/00* (2013.01); *F25B 13/00* (2013.01); *F28F 2235/00* (2013.01)

(56) References Cited

U.S. PATENT DOCUMENTS

| | | | | | |
|---|---|---|---|---|---|
| 5,495,910 | A * | 3/1996 | Stauffer | B62D 25/10 | 123/41.7 |
| 5,538,079 | A * | 7/1996 | Pawlick | F28D 1/05366 | 165/153 |
| 6,019,162 | A * | 2/2000 | Saida | B60H 1/00521 | 165/42 |
| 2002/0134099 | A1 * | 9/2002 | Mochizuki | F24F 1/18 | 62/285 |
| 2003/0051497 | A1 * | 3/2003 | Nomura | B60H 1/00521 | 62/239 |
| 2007/0204983 | A1 * | 9/2007 | Ichiyanagi | F25B 9/008 | 165/176 |
| 2009/0120610 | A1 * | 5/2009 | Coyle | B60H 1/00321 | 165/67 |
| 2012/0048633 | A1 * | 3/2012 | Williams | B60K 11/04 | 180/68.4 |
| 2012/0132396 | A1 * | 5/2012 | Komatsubara | B60H 1/00521 | 165/67 |

FOREIGN PATENT DOCUMENTS

| | | | | |
|---|---|---|---|---|
| JP | 6-117792 | A | | 4/1994 |
| JP | 6-229696 | A | | 8/1994 |
| JP | 9-42888 | A | | 2/1997 |
| JP | 9-202 | U | | 4/1997 |
| JP | 10227582 | A | * | 8/1998 |
| JP | 2011-117628 | A | | 6/2011 |
| JP | 2012-163290 | A | | 8/2012 |

OTHER PUBLICATIONS

International Preliminary Report of corresponding PCT Application No. PCT/JP2013/052594 dated Aug. 28, 2014.

European Search Report of corresponding EP Application No. 13 74 9421.7 dated Nov. 5, 2015.

* cited by examiner

OUTDOOR UNIT OF REFRIGERATION APPARATUS

CROSS-REFERENCE TO RELATED APPLICATIONS

This U.S. National stage application claims priority under 35 U.S.C. §119(a) to Japanese Patent Application No. 2012-028387, filed in Japan on Feb. 13, 2012, the entire contents of which are hereby incorporated herein by reference.

TECHNICAL FIELD

The present invention relates to an outdoor unit of a refrigeration apparatus.

BACKGROUND ART

Among refrigeration apparatus, there is, as described in JP-A No. 2011-117628 for example, a refrigeration apparatus equipped with a heat exchanger made of aluminum having numerous fins comprising aluminum or aluminum alloy, plural heat transfer tubes comprising aluminum or aluminum alloy that are inserted through the numerous fins, and a pair of distribution pipes (collection header pipes) to which the plural heat transfer tubes are connected.

SUMMARY OF INVENTION

Technical Problem

Looking at the heat exchanger described in JP-A No. 2011-117628, interstices between the distribution pipes and the fins adjacent to the distribution pipes are depicted as being wide compared to the fin pitch of the numerous fin bodies that are layered, and in this way sometimes the interstices between the distribution pipes and the fins are wider than the fin pitch. Particularly in the heat exchanger made of aluminum described in patent document 1, the interstices between the distribution pipes and the adjacent fins tend to be wide due to the way the heat exchanger is manufactured.

When the interstices between the distribution pipes and the fins are wide in this way, the interstices become airflow bypasses, and near the interstices a phenomenon occurs where the air travels through the interstices without passing between the fins. When such airflow bypassing occurs, the heat exchange efficiency of the heat exchanger is lowered.

Furthermore, when the heat transfer tubes have a flat shape such as described in JP-A No. 2011-117628, moisture collects on the heat transfer tubes and evaporates, and in a case where the heat transfer tubes and the distribution pipes are made of aluminum or aluminum alloy, the heat transfer tubes and the distribution pipes corrode more easily due to salt damage or the like.

It is a problem of the present invention to prevent the heat exchange efficiency of a heat exchanger from being lowered by interstices between collection header pipes and fins adjacent to the collection header pipes.

Solution to Problem

An outdoor unit of a refrigeration apparatus pertaining to a first aspect of the present invention comprises: a heat exchanger that has plural collection header pipes, plural fins that are disposed at a predetermined fin pitch between the plural collection header pipes, and plural heat transfer tubes that are inserted through the plural fins and are connected to the plural collection header pipes, with an interstice larger than the fin pitch, the interstice being formed between one of the collection header pipes and one of the fins adjacent to the one of the collection header pipes; a casing constituent member disposed facing the one of the plural collection header pipes and configured to surround part of the heat exchanger; and a seal member that is attached to the casing constituent members, is pressed against one of the collection header pipes and one of the fins in the environ of the interstice facing the casing constituent member, becomes deformed, and closes the interstice.

In the outdoor unit of the refrigeration apparatus pertaining to the first aspect, the seal member is pressed against the collection header pipes and the fins in the environ of the interstice, and the seal member becomes deformed and closes the interstice, so the interstice can be sufficiently closed to the extent that airflows do not travel between the seal member, fins, and the collection header pipes.

An outdoor unit of a refrigeration apparatus pertaining to a second aspect of the present invention is the outdoor unit of the refrigeration apparatus pertaining to the first aspect, wherein the casing constituent member includes a first casing constituent member disposed on an upwind side of the heat exchanger, and the seal member includes a first seal member attached to the first casing constituent member and disposed on the upwind side of the interstice.

In the outdoor unit of the refrigeration apparatus pertaining to the second aspect, occurrences in which air that has entered from outside the outdoor unit contacts the collection header pipe, the heat transfer tubes, and the fin in the environ of the interstice can be reduced by the first seal member disposed on the upwind side.

An outdoor unit of a refrigeration apparatus pertaining to a third aspect of the present invention is the outdoor unit of the refrigeration apparatus of the second aspect, wherein the casing constituent member includes a second casing constituent member that is disposed on a downwind side of the heat exchanger, and the seal member includes a second seal member that is attached to the second casing constituent member and is disposed on the downwind side of the interstices.

In the outdoor unit of the refrigeration apparatus pertaining to the third aspect, occurrences in which airflows that have passed between the plural fins flow back around and contact the collection header pipe, the heat transfer tubes, and the fin in the environ of the interstice from the downwind side can be reduced by the second seal member disposed on the downwind side.

An outdoor unit of a refrigeration apparatus pertaining to a fourth aspect of the present invention is the outdoor unit of the refrigeration apparatus of the third aspect, wherein the first casing constituent member and the second casing constituent member are joined to one another in order to surround a space around the collection header pipe against which the first seal member and the second seal member are pressed.

In the outdoor unit of the refrigeration apparatus pertaining to the fourth aspect, the space around the collection header pipe against which the first seal member and the second seal member are pressed can be brought closer to a windless state by the first casing constituent member and the second casing constituent member.

An outdoor unit of a refrigeration apparatus pertaining to a fifth aspect of the present invention is the outdoor unit of the refrigeration apparatus of the fourth aspect, wherein the first casing constituent member is amide panel, the second casing constituent member is an air blocking plate that prevents air that has passed through the heat exchanger from contacting the header collection tube, and the outdoor unit further comprises a third seal member that joins the side panel and the air blocking plate to one another.

In the outdoor unit of the refrigeration apparatus pertaining to the fifth aspect, the side plate and the air blocking plate can be joined together via the third seal member to place the space around the header collection tube in a windless state, so compared to a case where the side plate and the air blocking plate are directly joined together, assembly becomes easier and there are also fewer occurrences of noise.

An outdoor unit of a refrigeration apparatus pertaining to a sixth aspect of the present invention is the outdoor unit of the refrigeration apparatus pertaining to any of the first aspect to the fifth aspect, wherein the seal member is also pressed against the plural heat transfer tubes and become deformed.

In the outdoor unit of the refrigeration apparatus pertaining to the sixth aspect, the spaces between the seal member and the heat transfer tubes are also sufficiently closed, so airflows entering as a result of passing between the heat transfer tubes and the seal member from a direction intersecting the heat transfer tubes can also be blocked.

An outdoor unit of a refrigeration apparatus pertaining to a seventh aspect of the present invention is the outdoor unit of the refrigeration apparatus of any of the first aspect to the sixth aspect, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that their side surfaces oppose one another, and the plural fins are made of aluminum or aluminum alloy.

In the outdoor unit of the refrigeration apparatus pertaining to the seventh aspect, the weight of the outdoor unit is made lighter by the heat exchanger made of aluminum or aluminum alloy, and it becomes easier to prevent the collection header pipes, the multi-hole flat tubes, and the fins made of aluminum or aluminum alloy in the environs of the interstices from sustaining salt damage.

An outdoor unit of a refrigeration apparatus pertaining to an eighth aspect of the present invention is the outdoor unit of the refrigeration apparatus of any of the first aspect to the seventh aspect, wherein the seal members each comprise a closed-cell polymer foam.

In the outdoor unit of the refrigeration apparatus pertaining to the eighth aspect, the polymer foam is soft and easily deform, so it easily closes the interstice of the heat exchanger while preventing the fins from becoming greatly deformed. Moreover, because the polymer form is closed-cell foam, in contrast to open-cell foam, moisture does not collect inside the polymer form, so corrosion is also suppressed.

Advantageous Effects of Invention

In the outdoor unit of the refrigeration apparatus pertaining to the first aspect, the heat exchange efficiency of the heat exchanger can be prevented from being lowered due to the one of the interstices wider than the fin pitch between the one of the collection header pipes and the one of the fins adjacent to the one of the collection header pipes.

In the outdoor unit of the refrigeration apparatus pertaining to the second aspect, it becomes more difficult for outdoor air to contact the one of the collection header pipes, the heat transfer tubes, and the one of the fins in the environ of the interstice, and it becomes easier to prevent salt damage.

In the outdoor unit of the refrigeration apparatus pertaining to the third aspect, it becomes even more difficult for outdoor air to contact the one of the collection header pipes, the heat transfer tubes, and the one of the fins in the environ of the interstice, and it becomes even easier to prevent salt damage.

In the outdoor unit of the refrigeration apparatus pertaining to the fourth aspect, it becomes difficult for air that has entered from outside the outdoor unit to contact the one of the collection header pipe against which the first seal member and the second seal member are pressed, so salt damage not only in the environ of the interstice but also to the entire the one of collection header pipes can be prevented.

In the outdoor unit of the refrigeration apparatus pertaining to the fifth aspect, assembly is easy and the occurrence of noise can be suppressed even while preventing salt damage to the entire the one of collection header pipes.

In the outdoor unit of the refrigeration apparatus pertaining to the sixth aspect, it becomes difficult for outdoor air to enter the interstice between the one of the collection header pipes and the one of the fins adjacent thereto, and it becomes easier to prevent salt damage.

In the outdoor unit of the refrigeration apparatus pertaining to the seventh aspect, a heat exchanger that is lightweight and highly durable can be provided.

In the outdoor unit of the refrigeration apparatus pertaining to the eighth aspect, by using closed-cell polymer foam, costs associated with improving the heat exchange efficiency can be suppressed.

DESCRIPTION OF EMBODIMENT

(1) Overall Configuration of Air Conditioning Apparatus

Figure 1:
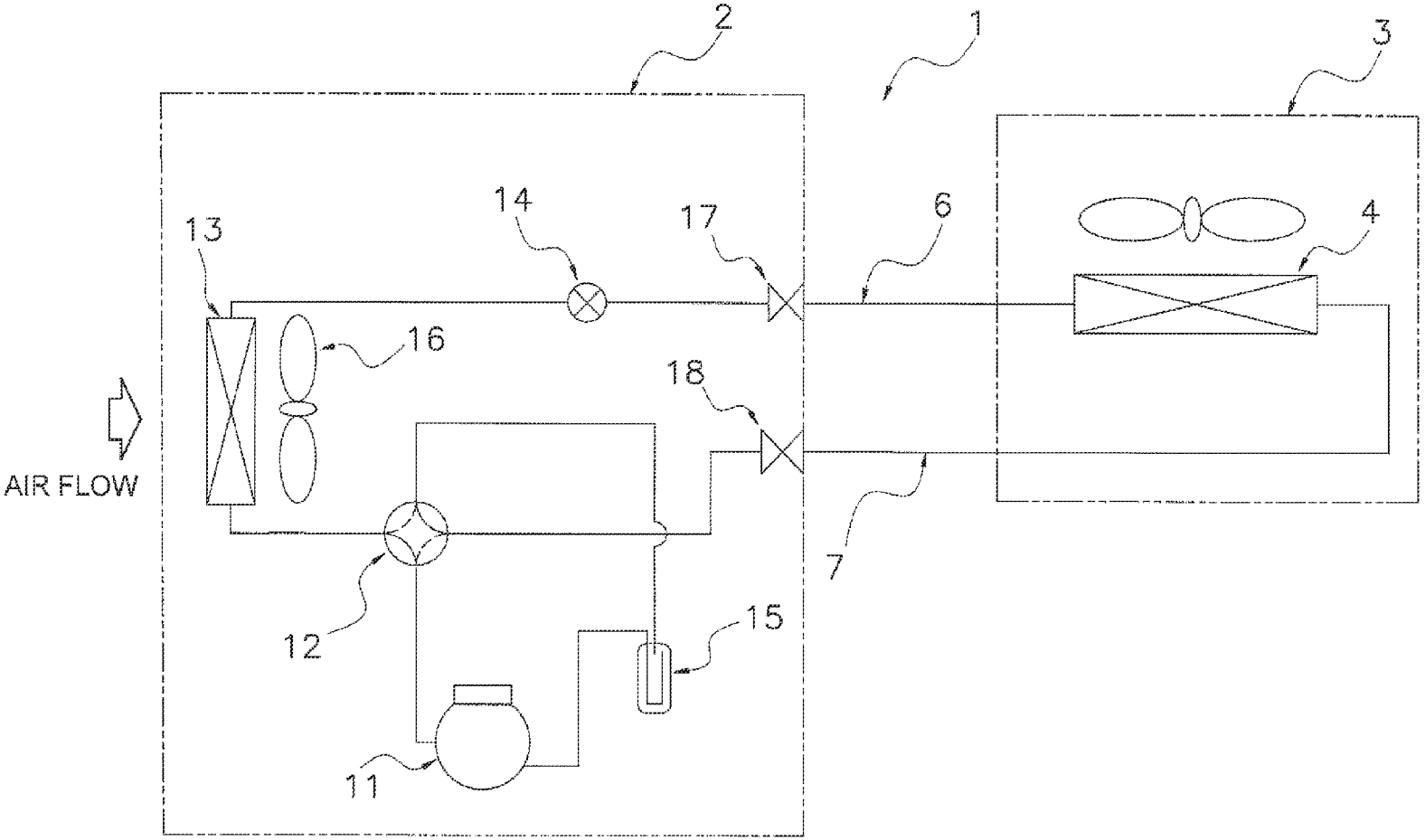
FIG. 1 is a circuit diagram for describing an overview of the configuration of an air conditioning apparatus pertaining to an embodiment.

A refrigeration apparatus used in an air conditioning apparatus will be described as a refrigeration apparatus pertaining to an embodiment of the present invention. FIG. 1 is a circuit diagram showing an overview of an air conditioning apparatus. An air conditioning apparatus 1 is configured by an outdoor unit 2 and an indoor unit 3. The air conditioning apparatus 1 is an apparatus used to cool and heat rooms in a building by performing a vapor compression refrigeration cycle operation. The air conditioning apparatus 1 is equipped with the outdoor unit 2 that serves as a heat source unit, the indoor unit 3 that serves as a utilization unit, and refrigerant connection tubes 6 and 7 that interconnect the outdoor unit 2 and the indoor unit 3.

A refrigeration apparatus configured by connecting the outdoor unit 2, the indoor unit 3, and the refrigerant connection tubes 6 and 7 has a configuration wherein a compressor 11, a four-way switching valve 12, an outdoor heat exchanger 13, an expansion valve 14, an indoor heat exchanger 4, and an accumulator 15 are interconnected by refrigerant tubes. The refrigeration apparatus is charged with refrigerant, and a refrigeration cycle operation is performed wherein the refrigerant is compressed, is cooled, has its pressure reduced, is heated and evaporated, and is thereafter compressed again. During operation, a liquid refrigerant-side stop valve 17 and a gas refrigerant-side stop valve 18 of the outdoor unit 2 that are connected to the refrigerant connection tubes 6 and 7, respectively, are placed in an open state.

During the cooling operation, the four-way switching valve 12 is switched to a state indicated by the solid lines in FIG. 1, that is, a state in which the discharge side of the compressor 11 is connected to the gas side of the outdoor heat exchanger 13 and in which the suction side of the compressor 11 is connected to the gas side of the indoor heat exchanger 4 via the accumulator 15, the gas refrigerant-side stop valve 18, and the refrigerant connection tube 7. In the cooling operation, the air conditioning apparatus 1 causes the outdoor heat exchanger 13 to function as a condenser of the refrigerant compressed in the compressor 11 and causes the indoor heat exchanger 4 to function as an evaporator of the refrigerant that has been condensed in the outdoor heat exchanger 13.

During the heating operation, the four-way switching valve 12 is switched to a state indicated by the dashed lines in FIG. 1, that is, a state in which the discharge side of the compressor 11 is connected to the gas side of the indoor heat exchanger 4 via the gas refrigerant-side stop valve 18 and the refrigerant connection tube 7 and in which the suction side of the compressor 11 is connected to the gas side of the outdoor heat exchanger 13. In the heating operation, the air conditioning apparatus 1 causes the indoor heat exchanger 4 to function as a condenser of the refrigerant compressed in the compressor 11 and causes the outdoor heat exchanger 13 to function as an evaporator of the refrigerant that has been condensed in the indoor heat exchanger 4.

(2) Outdoor Unit

Figure 2:
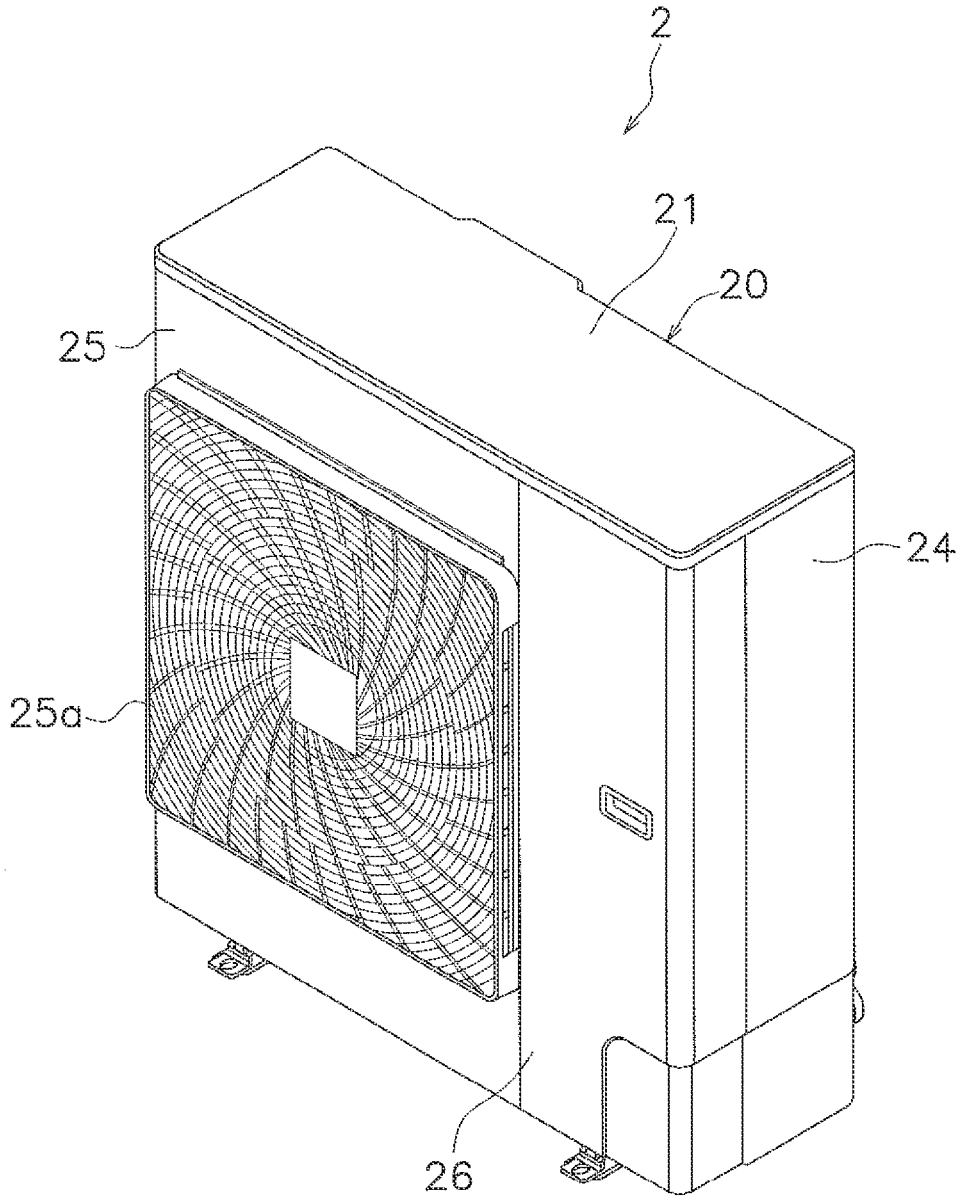
FIG. 2 is a perspective view showing the outer appearance of an air conditioning outdoor unit.
Figure 3:
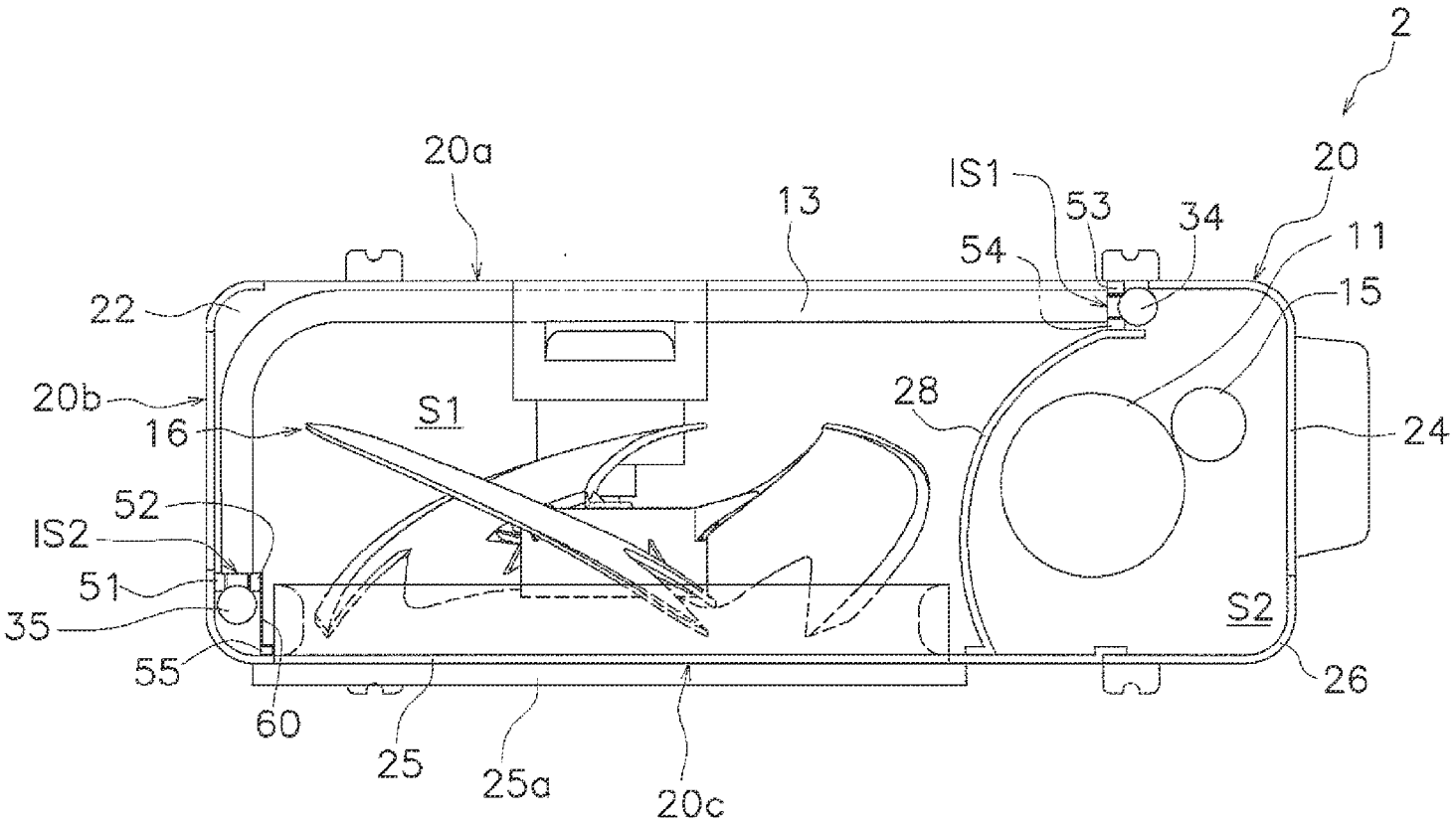
FIG. 3 is a schematic plan view of the air conditioning outdoor unit in a state in which a top panel has been removed.

The outdoor unit 2, which is installed outside a house or a building, is equipped with a substantially cuboidal unit casing 20 as shown in FIG. 2 and FIG. 3. As shown in FIG. 3, the outdoor unit 2 has a structure (a so-called trunk structure) in which a blower chamber S1 and a machine chamber S2 are formed as a result of the inside space of the unit casing 20 being divided in two by a partition panel 28 extending in the vertical direction. The outdoor heat exchanger 13 and an outdoor fan 16 are disposed in the blower chamber S1, and the compressor 11 and the accumulator 15 are disposed in the machine chamber S2.

The unit casing 20 is configured to include a top panel 21 that is a panel member made of sheet steel, a bottom panel 22, a machine chamber-side side panel 24, a blower chamber-side side panel-cum-blower chamber-side front panel 25 (hereinafter called the blower chamber-side front panel 25), and a machine chamber-side front panel 26. Here, the blower chamber-side side panel and the blower chamber-side front panel are configured by a single sheet of sheet steel, but the blower chamber-side side panel and the blower chamber-side front panel may also be configured by separate members. The machine chamber-side side panel 24 configures part of the side surface section of the unit casing 20 near the machine chamber S2 and the back surface section of the unit casing 20 near the machine chamber S2.

The outdoor unit 2 is configured to suck outdoor air into the blower chamber S1 inside the unit casing 20 from the back surface and part of the side surface of the unit casing 20 and blow out the sucked-in outdoor air from the front surface of the unit casing 20. For that reason, an air inlet 20*a* for the outdoor air sucked into the blower chamber S1 inside the unit casing 20 is formed between the end portion of the blower chamber-side front panel 25 on the back surface side and the end portion of the machine chamber-side side panel 24 on the blower chamber S1 side, and an air inlet 20*b* for the outdoor air is formed in the blower chamber-side front panel 25. Furthermore, an air outlet 20*c* for blowing outside the outdoor air that has been sucked into the blower chamber S1 is disposed in the blower chamber-side front panel 25. The front side of the air outlet 20*c* is covered by a fan grille 25*a*.

(2-1) Outdoor Heat Exchanger

Figure 4:
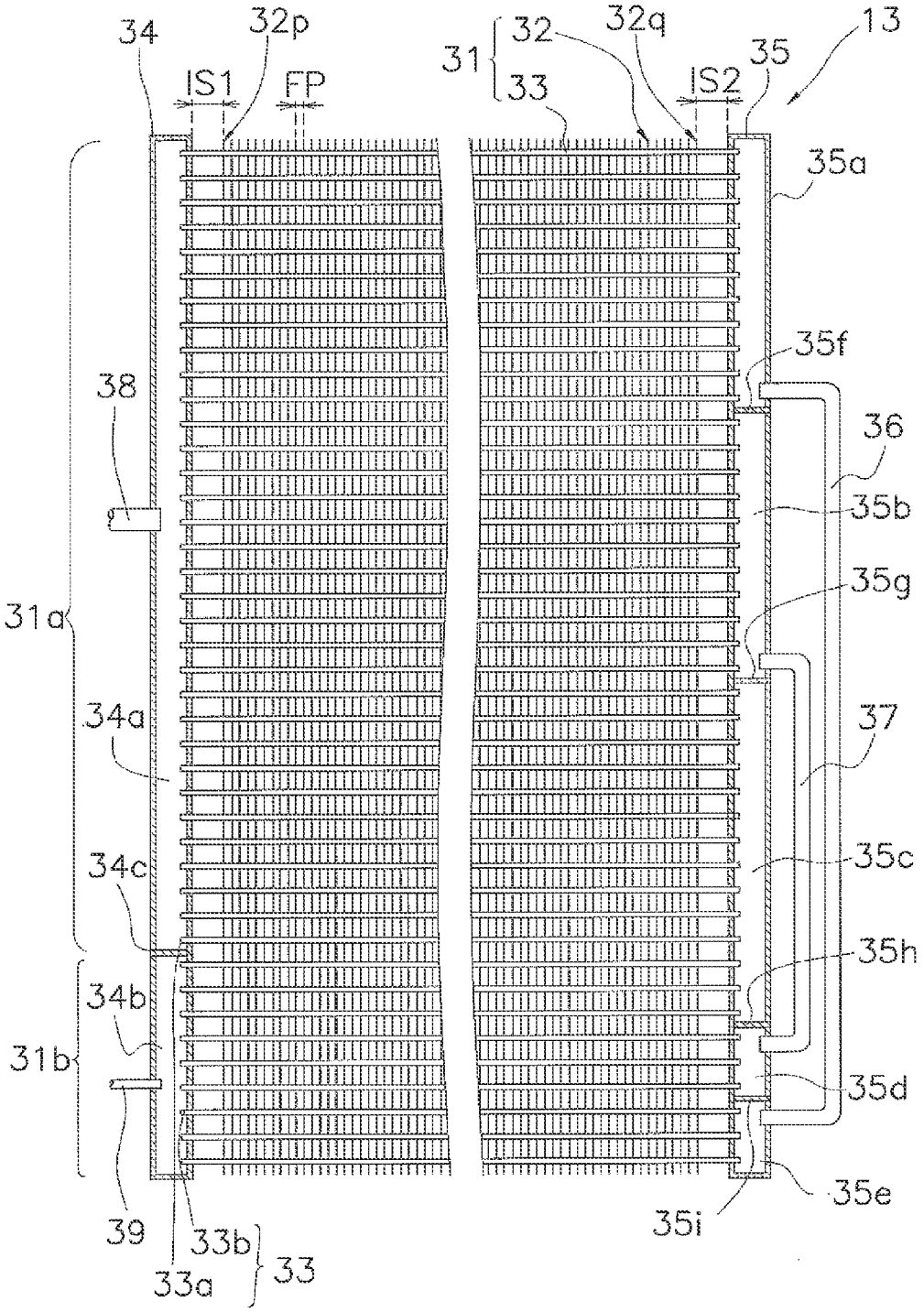
FIG. 4 is a partial sectional view for describing the configuration of an outdoor heat exchanger.

Next, the configuration of the outdoor heat exchanger 13 will be described in detail using FIG. 4 and FIG. 5. The heat exchanger made of aluminum is configured by heat transfer fins 32 made of aluminum, multi-hole flat tubes 33 made of aluminum, and two collection header pipes 34 and 35 made of aluminum. The outdoor heat exchanger 13 is equipped with a heat exchange section 31 that causes heat exchange to be performed between the outdoor air and the refrigerant, and the heat exchange section 31 is configured by the numerous heat transfer fins 32 made of aluminum and the numerous multi-hole flat tubes 33 made of aluminum. The multi-hole flat tubes 33 are inserted into the numerous heat transfer fins 32, function as heat transfer tubes, and cause the heat moving between the heat transfer fins 32 and the outdoor air to be exchanged between the refrigerant flowing inside of the tubes 33 and the heat transfer fins 32.

Figure 5:
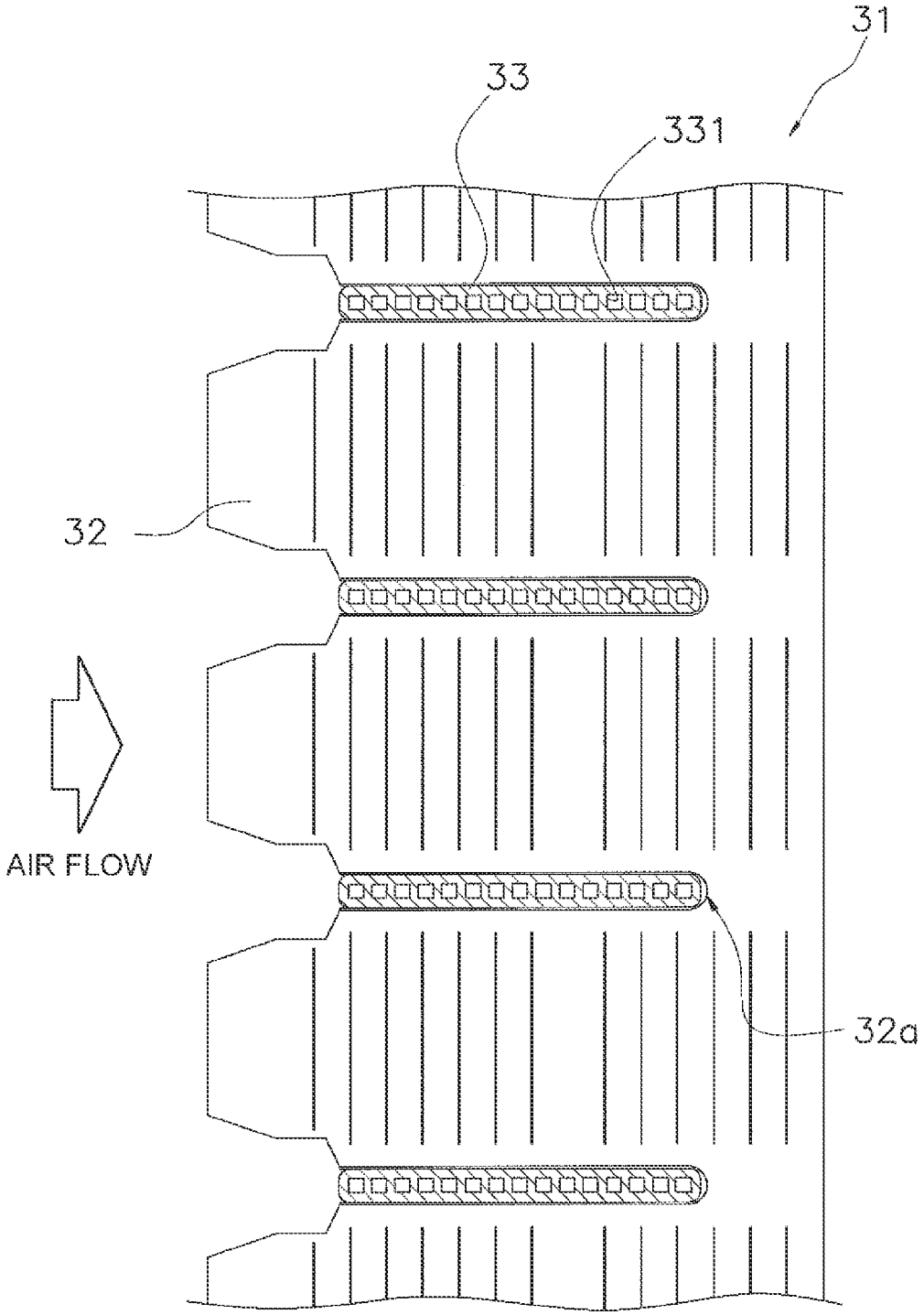
FIG. 5 is an enlarged sectional view for describing the configuration of a heat exchange section of the outdoor heat exchanger.

FIG. 5 is a partially enlarged view showing the cross-sectional structure of the heat exchange section 31 of the outdoor heat exchanger 13 as cut by a plane perpendicular to the lengthwise direction of the multi-hole flat tubes 33. The heat transfer fins 32 are flat plates made of thin aluminum, and plural cutouts 32*a* extending in the horizontal direction are formed adjacent to one another in the up and down direction in the heat transfer fins 32. The multi-hole flat tubes 33 have upper and lower planar portions serving as heat transfer surfaces and plural inside flow paths 331 through which the refrigerant flows. The multi-hole flat tubes 33, which are slightly thicker than the up and down width of the cutouts 32*a*, are arranged in plural tiers at intervals between the tubes 33 in a state in which the planar portions face up and down (a state in which the side surfaces of the multi-hole flat tubes 33 are arranged opposing one another), and the multi-hole flat tubes 33 are temporarily fixed in a state in which they have been fitted into the cutouts 32*a*. The heat transfer fins 32 and the multi-hole flat tubes 33 are brazed together in a state in which the multi-hole flat tubes 33 have been fitted into the cutouts 32*a* in the heat transfer fins 32 in this way. Furthermore, both ends of each of the multi-hole flat tubes 33 are fitted into and brazed to the collection header pipes 34 and 35.

The numerous heat transfer fins 32 are disposed at predetermined intervals between the fins 32, and the interval between the heat transfer fins 32 adjacent to one another is a fin pitch FP.

The heat exchange section 31 has an upper heat exchange section 31*a* and a lower heat exchange section 31*b*. In the upper heat exchange section 31*a*, gas refrigerant multi-hole flat tubes 33*a* of the numerous multi-hole flat tubes 33 are disposed. To the lower heat exchange section 31*b*, liquid refrigerant multi-hole flat tubes 33*b* of the numerous multi-hole flat tubes 33 are connected. When the outdoor heat exchanger 13 functions as a condenser, the gas refrigerant multi-hole flat tubes 33*a* allows gas refrigerant or refrigerant in a gas-liquid two-phase state to flow through the tubes 33*a*, and the liquid refrigerant multi-hole flat tubes 33*b* allows the refrigerant in the gas-liquid two-phase state or liquid refrigerant to flow through the tubes 33*b*.

The outdoor heat exchanger 13 is equipped with the collection header pipes 34 and 35 made of aluminum that are disposed one each on both ends of the heat exchange section 31. The header collection tube 34 has a cylindrical pipe structure made of aluminum and has inside spaces 34*a* and 34*b* partitioned from one another by a baffle 34*c* made of aluminum. A heat exchanger-side gas tube 38 made of aluminum is connected to the inside space 34*a* in the upper portion of the header collection tube 34, and a heat exchanger-side liquid tube 39 made of aluminum is connected to the inside space 34*b* in the lower portion of the header collection tube 34.

The header collection tube 35 has a cylindrical pipe structure made of aluminum, and inside spaces 35*a*, 35*b*, 35*c*, 35*d*, and 35*e* are formed in the header collection tube 35 as a result of the inside space of the header collection tube 35 being partitioned by baffles 35*f*, 35*g*, 35*h*, and 35*i* made of aluminum. The numerous gas refrigerant multi-hole flat tubes 33*a* connected to the inside space 34*a* in the upper portion of the header collection tube 34 are connected to the three inside spaces 35*a*, 35*b*, and 35*c* of the header collection tube 35. Furthermore, the numerous liquid refrigerant multi-hole flat tubes 33*b* connected to the inside space 34*b* in the lower portion of the header collection tube 34 are connected to the three inside spaces 35*c*, 35*d*, and 35*e* of the header collection tube 35.

An interstice IS1 is formed between the header collection tube 34 and a heat transfer fin 32*p* adjacent thereto, and an interstice IS2 is formed between the header collection tube 35 and a heat transfer fin 32*q* adjacent thereto. The fin pitch FP is about 1.5 mm, for example, and the interstices IS1 and IS2 are about 10 mm, for example. If air is allowed to flow through like this when there is a difference of fivefold or greater between the fin pitch FP and the interstices IS1 and IS2 in this way, near the interstices IS1 and IS2 it becomes difficult for the air to flow between the heat transfer fins 32 because the air bypasses the heat transfer fins 32 and travels through the interstices IS1 and IS2.

The inside space 35*a* and the inside space 35*e* of the header collection tube 35 are interconnected by a connection tube 36 made of aluminum, and the inside space 35*b* and the inside space 35*d* are interconnected by a connection tube 37 made of aluminum. The inside space 35*c* also fulfills the function of interconnecting part of the inside space in the upper portion of the heat exchange section 31 (the section connected to the inside space 34*a*) and part of the inside space in the lower portion of the heat exchange section 31 (the section connected to the inside space 34*b*). Because of these configurations, during the cooling operation (when the outdoor heat exchanger 13 functions as a condenser) for example, the gas refrigerant supplied to the inside space 35*a* in the upper portion of the header collection tube 35 by the heat exchanger-side gas tube 38 made of aluminum performs heat exchange in the upper portion of the heat exchange section 31, some of that refrigerant liquefies so that the refrigerant changes to a gas-liquid two-phase state, the refrigerant in the gas-liquid two-phase state doubles back in the header collection tube 35 and travels through the lower portion of the heat exchange section 31 where the remaining gas refrigerant liquefies, and the liquid refrigerant exits through the heat exchanger-side liquid tube 39 made of aluminum.

The inside spaces 34*a* and 34*b* of the header collection tube 34 and the inside spaces 35*a*, 35*b*, 35*c*, 35*d*, and 35*e* of the header collection tube 35 are connected to the inside flow paths 331 in the multi-hole flat tubes 33. Baffle plates for rectifying the flow of the refrigerant are disposed in the inside spaces 34*a* and 34*b* of the header collection tube 34 and the inside spaces 35*a*, 35*b*, 35*c*, 35*d*, and 35*e* of the header collection tube 35, but description of details such as these will be omitted.

An air blocking plate 60 that prevents the air that has passed through the outdoor heat exchanger 13 from contacting the header collection tube 35 is attached to the blower chamber S1 side of the header collection tube 35 of the outdoor heat exchanger 13. The air blocking plate 60 is formed by pressing sheet steel in order to ensure strength.

(2-2) Seal Structure of Outdoor Heat Exchanger

The outdoor unit 2 has a seal structure for closing the interstices IS1 and IS2 of the outdoor heat exchanger 13. Seal members 51, 52, 53, and 54 shown in FIG. 3 close the interstices IS1 and IS2. The seal members 51, 52, 53, and 54 are formed of foamed ethylene propylene (hereinafter called EPDM) rubber. The type of this foam is closed-cell foam, which has a structure where the cavities in the foam are not connected to one another. For that reason, closed-cell foam EPDM rubber is soft and easily deforms. Here, a case is described where closed-cell foam cuboidal EPDM rubber is used as a closed-cell polymer foam, but the polymer material configuring the seal member 51 is not limited to EPDM rubber. However, as already described, the outdoor heat exchanger 13 reaches high temperatures and reaches low temperatures and is also exposed to dew condensation water, so it is preferred that the polymer material forming the seal member 51 have the same heat resistance, cold resistance, and water resistance as EPDM rubber or greater.

As described above, the outdoor heat exchanger 13 reaches low temperatures and reaches high temperatures because it functions as an evaporator and a condenser. Furthermore, sometimes dew condensation water sticks to the surface of the outdoor heat exchanger 13, and moisture penetrates even to the places of the seal members 51, 52, 53, and 54. Keeping the seal members 51, 52, 53, and 54 comprising EPDM rubber adhered to the outdoor heat exchanger 13 for a long period of time with an adhesive in such an environment is difficult. Yet if the shape of the outdoor heat exchanger 13 is processed to dispose attachment structures for attaching the seal members instead of adhering them, this leads to an increase in cost because reliability must also be ensured at the same time.

Therefore, the seal member 51 is attached to the blower chamber-side front panel 25, the seal member 52 is attached to the air blocking plate 60, the seal member 53 is attached to the machine chamber-side side panel 24, and the seal member 54 is attached to the partition panel 28. The attachment of the seal members 51, 52, 53, and 54 to the blower chamber-side front panel 25, the air blocking plate 60, the machine chamber-side side panel 24, and the partition panel 28 is performed using an adhesive material, for example.

(2-3) Assembly of Outdoor Unit

The outdoor heat exchanger 13 has the two collection header pipes 34 and 35 and, as described above, the five seal members 51 to 55, but the method of attaching the seal members 51, 52, 53, and 54 in the interstices IS1 and IS2 of the two collection header pipes 34 and 35 is the same. Therefore, description of the assembly of the outdoor unit 2 pertaining to the seal members 53 and 54 will be omitted, and the assembly of the outdoor unit 2 will be described focusing on the section pertaining to the seal members 51, 52, and 55 located around the header collection tube 35.

Figure 6:
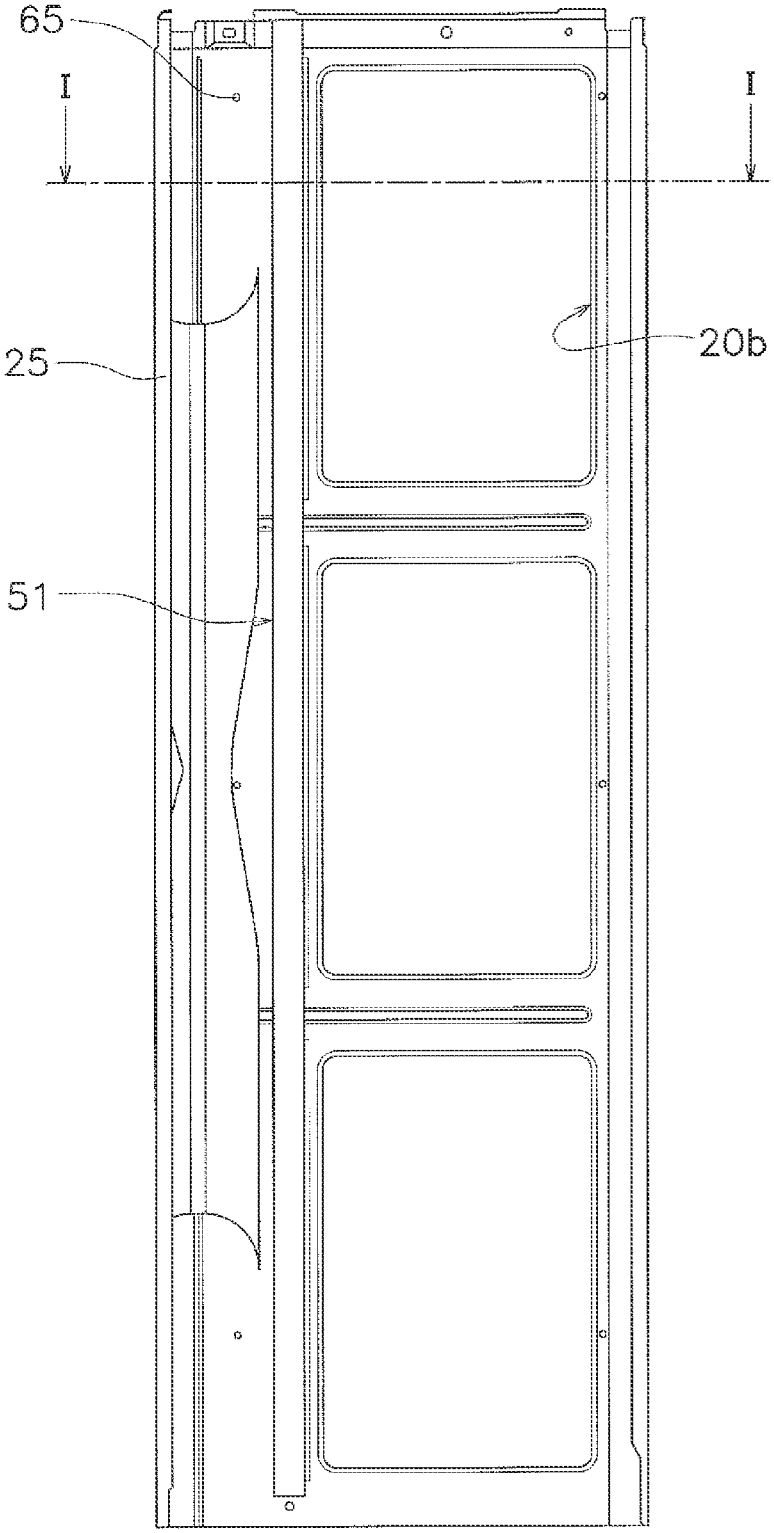
FIG. 6 is a side view of a blower chamber-side front panel to which a seal member is adhered.
Figure 7:
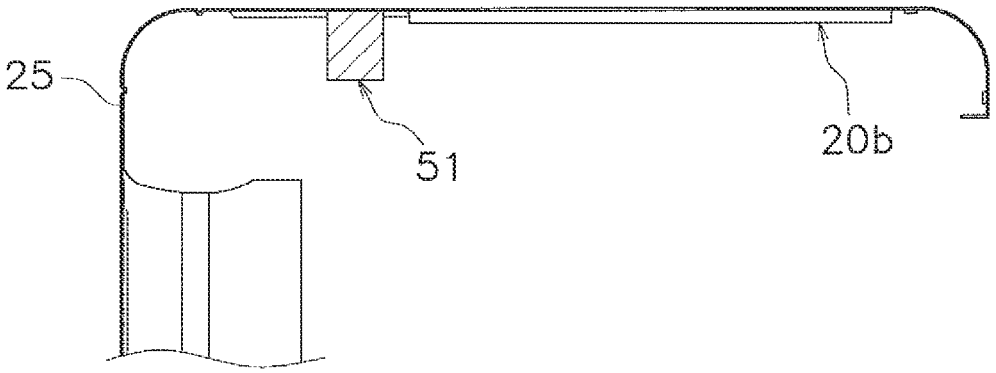
FIG. 7 is a sectional view taken along line I-I of FIG. 6.

FIG. 6 shows the inner surface of the blower chamber-side front panel 25 in a state in which the seal member 51 is adhered thereto. FIG. 7 shows a partial section as cut along line I-I of FIG. 6. As shown in FIG. 6 and FIG. 7, the seal member 51 is a cuboidal EPDM rubber molded product having a length substantially equal to the length from the top panel 21 to the bottom panel 22.

Figure 8:
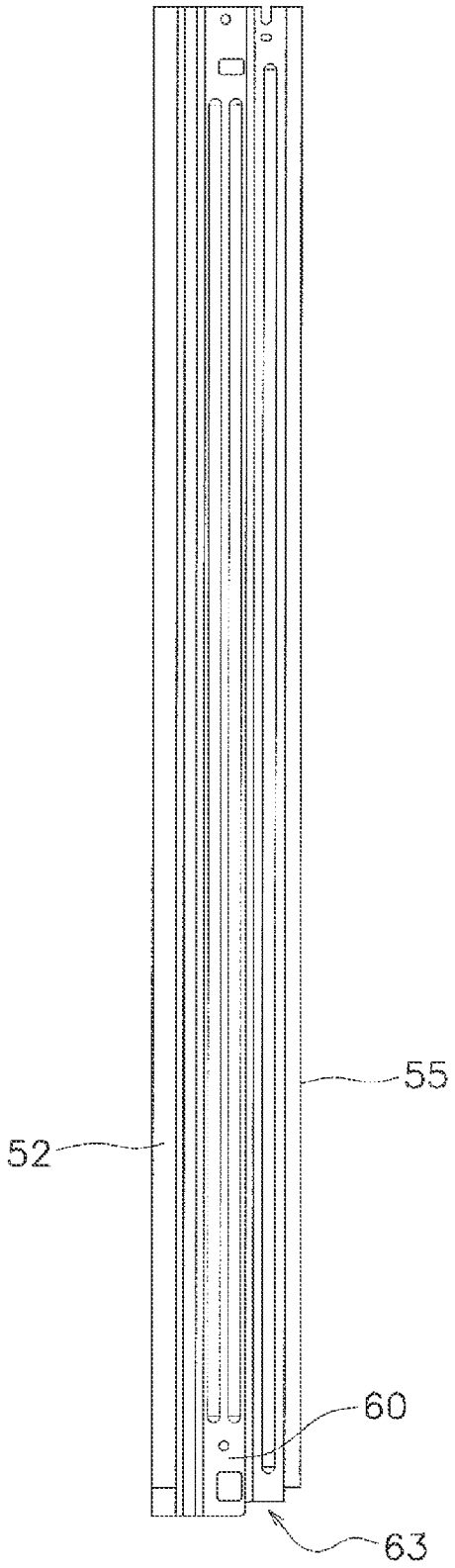
FIG. 8 is a side view of an air blocking plate to which seal members are adhered.
Figure 9:
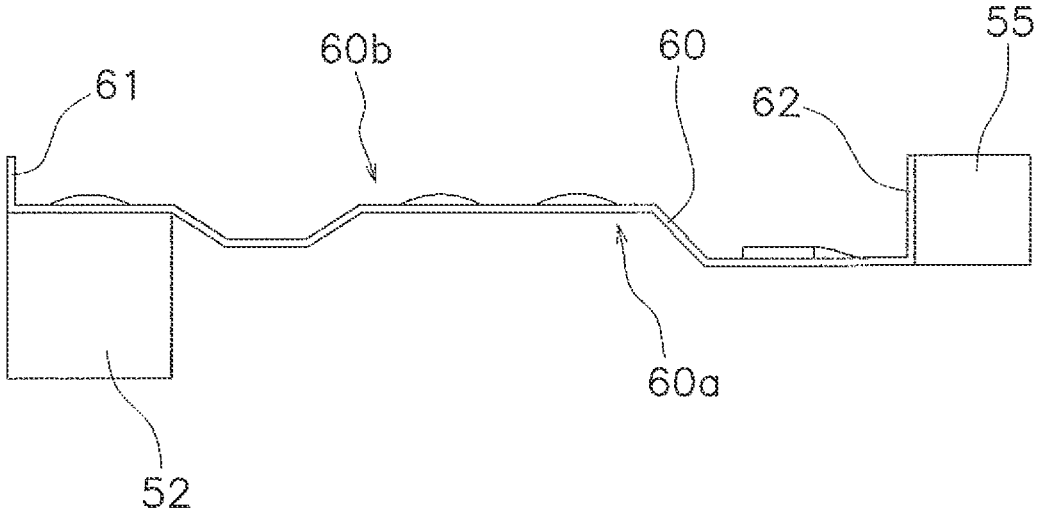
FIG. 9 is a plan view of the air blocking plate to which the seal members are adhered.

FIG. 8 shows the state of the front surface of the air blocking plate 60 in a state in which the seal members 52 and 55 are adhered thereto. FIG. 9 shows a plan state in which FIG. 8 is seen from above. As will be understood from FIG. 9, the air blocking plate 60 is bent in such a way that several flat surfaces extending in the lengthwise direction are formed. In particular, end portions 61 and 62 are bent at right angles relative to the width direction of the air blocking plate 60. The seal member 51 is adhered along the end portion 61 to a front surface 60*a* of the air blocking plate 60. Furthermore, the seal member 55 is adhered to the side of the end portion 62 opposing the blower chamber-side front panel 25. An end portion 63 on the bottom surface side of the air blocking plate 60 has a shape conforming to the shape of the bottom panel 22. That is, the entire end edge of the end portion 63 is attached in such a way as to contact the bottom panel 22.

Figure 10:
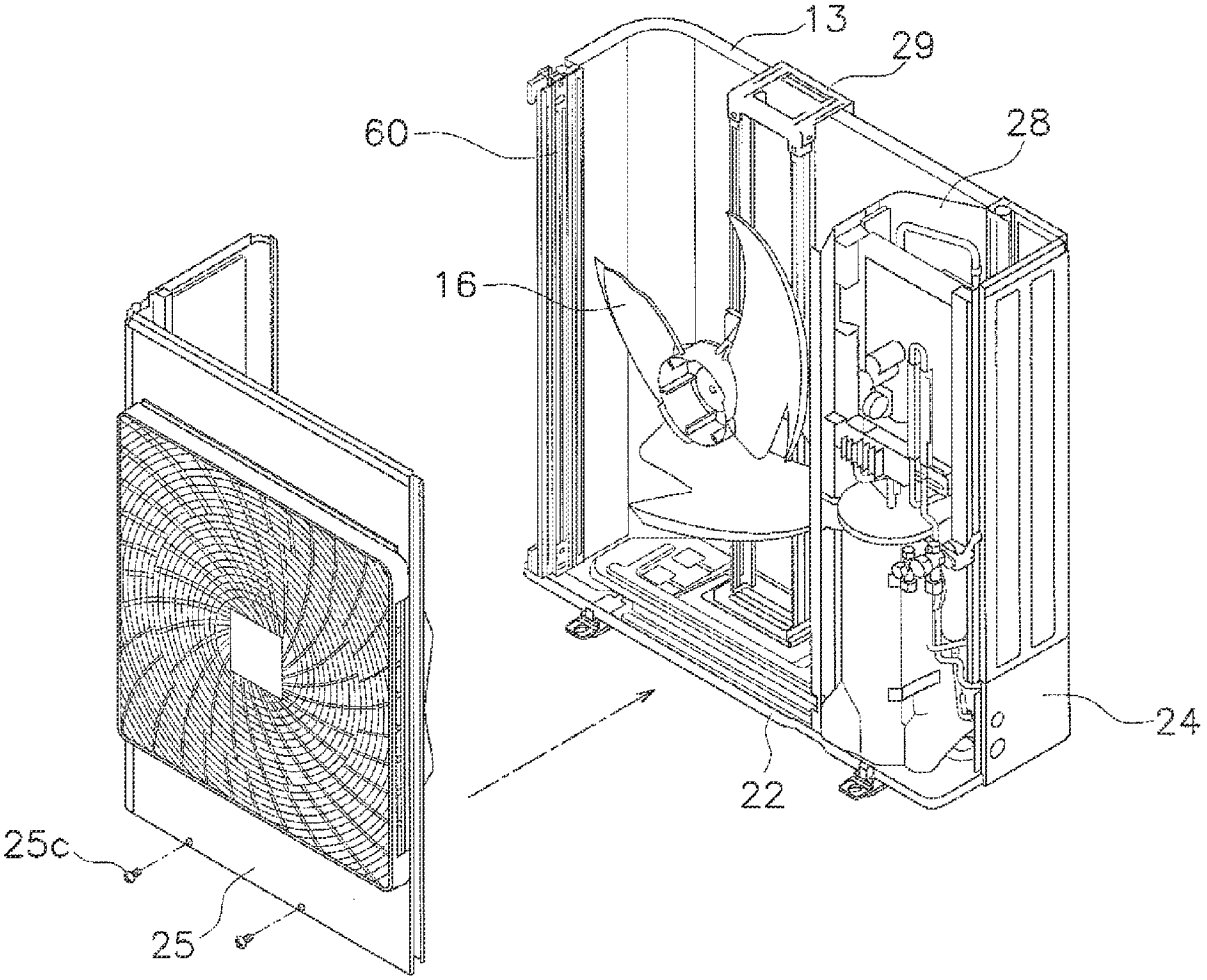
FIG. 10 is an exploded assembly diagram of the outdoor unit.

FIG. 10 is an exploded assembly diagram of the outdoor unit 2. The outdoor heat exchanger 13 shown in FIG. 10 is placed on the bottom panel 22 and is fixed to the machine chamber-side side panel 24, the partition panel 28, and a fan motor base 29. Additionally, the air blocking plate 60 is attached to the right side, as seen in a front view, of the header collection tube 35 of the outdoor heat exchanger 13.

Figure 11:
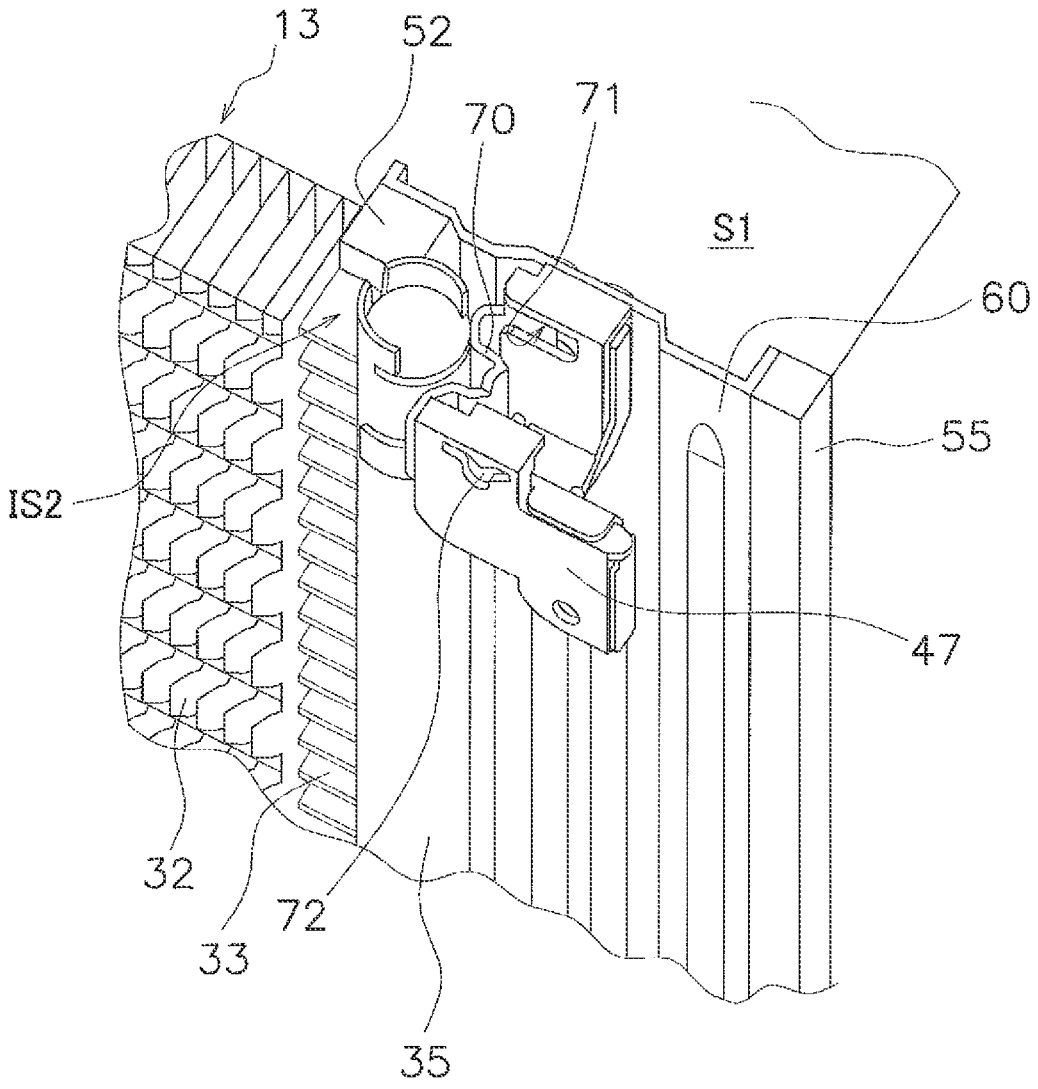
FIG. 11 is a partially enlarged perspective view of the air blocking plate attached to a header collection tube.

FIG. 11 shows an enlarged view of part of the air blocking plate 60 attached to the header collection tube 35. As shown in FIG. 11, a fixing member 70 for fixing the header collection tube 35 and the blower chamber-side front panel 25 is joined to the header collection tube 35. A screw is passed through a screw hole 71 in the fixing member 70 and a screw hole 65 (see FIG. 6) in the air blocking plate 60, and the header collection tube 35 and the blower chamber-side front panel 25 are fixed by this screw. The section of the fixing member 70 joined to the header collection tube 35 is formed of the same aluminum metal as the header collection tube 35, and there is a resin cover 47 on the section contacting the blower chamber-side front panel 25 and the air blocking plate 60. This prevents the promotion of corrosion resulting from contact between the aluminum and the sheet steel of the blower chamber-side front panel 25 and the air blocking plate 60. By tightening the screw, the seal member 52 is pressed by the air blocking plate 60, is pressed against the outdoor heat exchanger 13, and becomes deformed. Because the seal member 52 is pressed against the outdoor heat exchanger 13 and becomes deformed, the downwind side of the interstice IS2 of the outdoor heat exchanger 13 is closed by the seal member 52.

Figure 12:
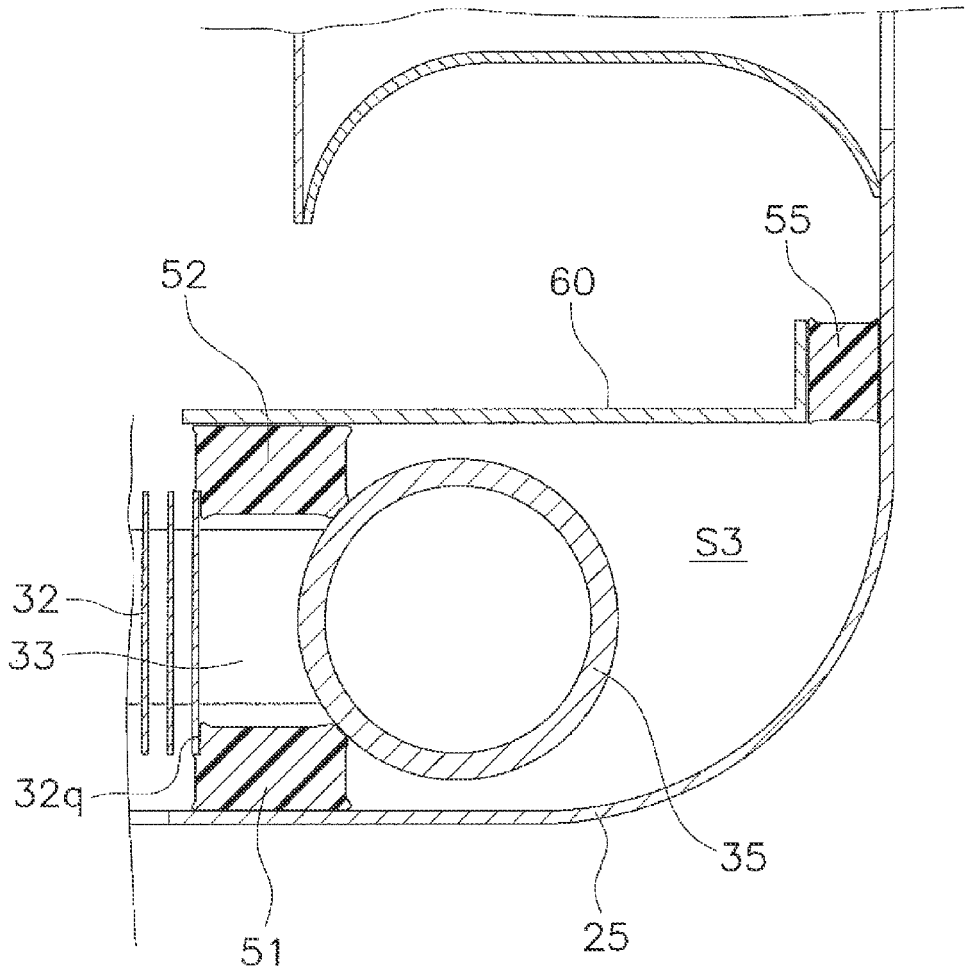
FIG. 12(*a*) is a partially enlarged sectional view schematically showing the seal members in the environs of the header collection tube, and FIG. 12(*b*) is a partially enlarged sectional view schematically showing the seal members in the environs of multi-hole flat tubes.
Figure 12:
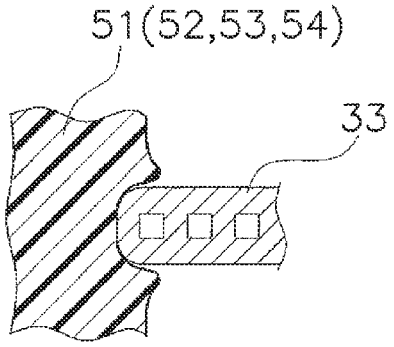

Furthermore, as shown in FIG. 10, the blower chamber-side front panel 25 is fixed by screws 25*c* to the bottom panel 22 fixed to the outdoor heat exchanger 13. FIG. 10 only shows screws 25*c* for fastening the front surface side of the blower chamber-side front panel 25, but the side surface of the blower chamber-side front panel 25 is also fixed by screws to the bottom panel 22 and the outdoor heat exchanger 13. A screw for fixing the blower chamber-side front panel 25 to the outdoor heat exchanger 13 is passed through a screw hole 72 in the fixing member 70 shown in FIG. 11. By fastening with a screw in this way, the seal member 51 is pressed by the blower chamber-side from panel 25, pressed against the outdoor heat exchanger 13, and becomes deformed. FIG. 12(*a*) schematically shows a state in which the seal members 51 and 52 are pressed against the header collection tube 35 and the heat transfer fin 32*q* and are deformed. Because the seal member 51 is pressed against the outdoor heat exchanger 13 and deforms, the upwind side of the interstice IS2 of the outdoor heat exchanger 13 is closed by the seal member 51. Furthermore, FIG. 12(*a*) schematically shows a state in which the seal member 55 is pressed by the air blocking plate 60 against the blower chamber-side front panel 25 and is deformed. In this way, the blower chamber-side front panel 25 and the air blocking plate 60 are joined together via the seal member 55, so the area around the header collection tube 35 can be surrounded by the blower chamber-side front panel 25 and the air blocking plate 60, and a space S3 around the header collection tube 25 can be put into a windless state.

After the blower chamber-side, front panel 25 shown in FIG. 10 has been fastened with screws, the top panel 21 is fitted and fastened with screws from above.

Although it is omitted in the above description, the seal member 53 adhered by the adhesive material to the machine chamber-side side panel 24 is pressed by the machine chamber-side side panel 24, is pressed against the header collection tube 34 and the heat transfer fin 32*p* in the environs of IS1, and becomes deformed. Because of that, the upwind side of the interstice IS1 of the outdoor heat exchanger 13 is closed by the seal member 53. Likewise, the seal member 54 adhered by the adhesive material to the partition panel 28 is pressed by the partition panel 28, is pressed against the header collection tube 34 and the heat transfer fin 32*p* in the environs of IS1, and becomes deformed. Because of that, the downwind side of the interstice IS1 of the outdoor heat exchanger 13 is closed by the seal member 54. Additionally, the machine chamber-side side panel 24 and the partition panel 28 are joined together via the machine chamber-side front panel 26 so that the machine chamber S2 is placed in a windless state. That is, the machine chamber-side side panel 24 and the partition panel 28 are joined together via the machine chamber-side front panel 26, whereby the area around the header collection tube 34 is surrounded by the machine chamber-side side panel 24 and the partition panel 28, and the space (the machine chamber S2) around the header collection tube 34 can be placed in a windless state.

(3) Characteristics of Outdoor Unit 3-1

In the outdoor unit 2, the seal members 51, 52, 53, and 54 adhered to the blower chamber-side front panel 25, the air blocking plate 60, the machine chamber-side side panel 24, and the partition panel 28 (examples of casing constituent members) are pressed against the collection header pipes 34 and 35 and the heat transfer fins 32 (an example of fins) in the environs of the interstices IS1 and IS2. For example, as shown in FIG. 12(*a*), the seal members 51, 52, 53, and 54 are pressed against the collection header pipes 34 and 35 and the heat transfer fins 32 and become deformed, and the interstices IS1 and IS2 are closed by the deformed seal members 51, 52, 53, and 54. For that reason, in the horizontal direction, the interstices IS1 and IS2 can be sufficiently closed to the extent that airflows do not travel between the seal members 51, 52, 53, and 54 and the collection header pipes 34 and 35 and heat transfer fins 32.

As a result, the heat exchange efficiency of the outdoor heat exchanger 13 can be prevented from being lowered due to the interstices IS1 and IS2 wider than the fin pitch between the collection header pipes 34 and 35 and the heat transfer fins 32*p* and 32*q* adjacent to the collection header pipes 34 and 35.

Looking at this more closely, occurrences where air that has entered from outside the outdoor unit 2 contacts the collection header pipes 34 and 35, the heat transfer fins 32, and the multi-hole flat tubes 33 in the environs of the interstices IS1 and IS2 are reduced by the seal members 51 and 53 (examples of first seal members) disposed on the upwind side. The seal members 51 and 53 are attached to the blower chamber-side front panel 25 and the machine chamber-side side panel 24 (examples of first casing constituent members) disposed on the upwind side of the outdoor heat exchanger 13. Because of that, it becomes more difficult for outdoor air to contact the collection header pipes 34 and 35, the heat transfer tubes 33, and the heat transfer fins 32 in the environs of the interstices IS1 and IS2, and it becomes easier to prevent salt damage.

Furthermore, occurrences where airflows that have passed between the plural heat transfer fins 32 flow back around and contact the collection header pipes 34 and 35, the heat transfer tubes 33, and the heat transfer fins 32 in the environs of the interstices IS1 and IS2 from the downwind side are reduced by the seal members 52 and 54 (examples of second seal members) disposed on the downwind side. The seal members 52 and 54 are attached to the air blocking plate 60 and the partition panel 28 (examples of second casing constituent members) disposed on the downwind side of the outdoor heat exchanger 13. Because of that, it becomes even more difficult for outdoor air to contact the collection header pipes 34 and 35, the heat transfer tubes 33, and the heat transfer fins 32 in the environs of the interstices IS1 and IS2, and it becomes even easier to prevent salt damage.

3-2

As shown in FIG. 3, the blower chamber-side front panel 25 (an example of a first casing constituent member) and the air blocking plate 60 (an example of a second casing constituent member) are joined together via the seal member 55 (an example of a third seal member) in order to surround the space S3 around the header collection tube 35, and the machine chamber-side side panel 24 (an example of a first casing constituent member) and the partition panel 28 (an example of a second casing constituent member) are joined together via the machine chamber-side front panel 26 in order to surround the space S2 around the header collection tube 34. Because of that, the spaces S2 and S3 can be brought closer to a windless state, and air sucked in from outside the outdoor unit 2 is not brought into contact with the collection header pipes 34 and 35, so salt damage not only in the environs of the interstices IS1 and IS2 but also to the entire collection header pipes 34 and 35 can be prevented.

3-3

In particular, the header collection tube 34 (an example of a first header collection tube) and the header collection tube 35 (an example of a second header collection tube) that configure the outdoor heat exchanger 13 are made of aluminum, all the multi-hole flat tubes 33 are made of aluminum, and all the heat transfer fins 32 are made of aluminum. For that reason, the outdoor heat exchanger 13 can be made lighter compared to a heat exchanger that includes copper and iron among its materials. However, aluminum corrodes more easily than copper and iron and tends to have a shorter life due to salt damage, for example. For that reason, although an anticorrosion treatment is administered, it is difficult to administer an anticorrosion treatment in the environs of the interstices IS1 and IS2, and these areas are exposed to salt damage and easily corrode. However, because the interstices IS1 and IS2 are closed by the seal members 51, 52, 53, and 54 as mentioned above, it becomes easier for the aluminum collection header pipes 34 and 35, the aluminum multi-hole flat tubes 33, and the aluminum heat transfer fins 32 in the environs of the interstices IS1 and IS2 to be prevented from sustaining salt damage, and the outdoor heat exchanger 13 made of aluminum is highly durable even though it is lightweight.

In the above embodiment, a case is described where the collection header pipes, the multi-hole flat tubes, and the heat transfer fins are made of aluminum, but these may also be made of aluminum alloy, which would achieve the same effects as the above embodiment.

3-4

The seal members 51, 52, 53, 54, and 55 comprise closed-cell foam EPDM rubber cuboids (an example of polymer molded products). Foamed EPDM rubber is soft and easily deforms, so it easily closes the interstices IS1 and IS2 in the outdoor heat exchanger 13. Moreover, because it is closed-cell foam, in contrast to open-cell foam, moisture does not collect inside the EPDM rubber cuboids, so corrosion of the outdoor heat exchanger 13 is also suppressed. In this way, by using closed-cell foam EPDM rubber cuboids, costs associated with improving the heat exchange efficiency of the outdoor heat exchanger 13 can be suppressed.

(4) Example Modifications (4-1) Example Modification A

In the above embodiment, a case is described where the seal members 51, 52, 53, and 54 are pressed against the collection header pipes 34 and 35 and the heat transfer fins 32 and become deformed, but as shown in FIG. 12(*b*), the seal members 51, 52, 53, and 54 may also be pressed against the plural heat transfer tubes 33 and become deformed. When configured like in FIG. 12(*b*), the spaces between the seal members 51, 52, 53, and 54 and the heat transfer tubes 33 are also sufficiently closed, so airflows entering from between the heat transfer tubes 33 and the seal members 51, 52, 53, and 54 from a direction intersecting the heat transfer tubes 33 can also be blocked. Because of that, it becomes more difficult fir outdoor air to enter the interstices IS1 and IS2 between the collection header pipes 34 and 35 and the heat transfer fins 32*p* and 32*q* adjacent thereto, and it becomes easier to prevent salt damage.

What is claimed is:

1. An outdoor unit of a refrigeration apparatus, the outdoor unit comprising:

a heat exchanger having plural collection header pipes, plural fins disposed at a predetermined fin pitch between the plural collection header pipes, and plural heat transfer tubes inserted through the plural fins and connected to the plural collection header pipes, with an interstice being formed between one of the collection header pipes and one of the fins adjacent to the one of the collection header pipes, and the interstice being larger than the fin pitch;

a compressor, a discharge side of the compressor being connected to the heat exchanger;

a unit casing enclosing both the heat exchanger and the compressor, the unit casing including a first casing constituent member disposed facing the one of the plural collection header pipes and configured to surround part of the heat exchanger, the first casing constituent member being disposed on an upwind side of the heat exchanger; and a first seal member attached to the first casing constituent member, the first seal member being pressed against the one of the collection header pipes and the one of the fins in an environ of the interstice facing the first casing constituent member, the first seal member becoming deformed and closing the interstice, the first seal member being disposed on the upwind side of the interstice.

2. The outdoor unit of the refrigeration apparatus according to claim 1, wherein the unit casing includes a second casing constituent member disposed on a downwind side of the heat exchanger, and a second seal member is attached to the second casing constituent member and disposed on the downwind side of the interstice.

3. The outdoor unit of the refrigeration apparatus according to claim 2, wherein the first casing constituent member and the second casing constituent member are joined to one another in order to surround a space around the collection header pipe against which the first seal member and the second seal member are pressed.

4. The outdoor unit of the refrigeration apparatus according to claim 3, further comprising a third seal member, the first casing constituent member being a side panel, the second casing constituent member being an air blocking plate that prevents air that has passed through the heat exchanger from contacting the header collection tube, and the third seal member joining the side panel and the air blocking plate to one another.

5. The outdoor unit of the refrigeration apparatus according to claim 1, wherein the first seal member is pressed against the plural heat transfer tubes and becomes deformed.

6. The outdoor unit of the refrigeration apparatus according to claim 1, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that side surfaces of the multi-hole flat tubes oppose one another, and the plural fins are made of aluminum or aluminum alloy.

7. The outdoor unit of the refrigeration apparatus according to claim 1, wherein the first seal member includes a closed-cell polymer foam.

8. The outdoor unit of the refrigeration apparatus according to claim 2, wherein the first seal member and the second seal member are pressed against the plural heat transfer tubes and becomes deformed.

9. The outdoor unit of the refrigeration apparatus according to claim 2, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that side surfaces of the multi-hole flat tubes oppose one another, and the plural fins are made of aluminum or aluminum alloy.

10. The outdoor unit of the refrigeration apparatus according to claim 2, wherein the first seal member and the second seal member include a closed-cell polymer foam.

11. The outdoor unit of the refrigeration apparatus according to claim 3, wherein the first seal member and the second seal member are pressed against the plural heat transfer tubes and become deformed.

12. The outdoor unit of the refrigeration apparatus according to claim 3, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that side surfaces of the multi-hole flat tubes oppose one another, and the plural fins are made of aluminum or aluminum alloy.

13. The outdoor unit of the refrigeration apparatus according to claim 3, wherein the first seal member and the second seal member include a closed-cell polymer foam.

14. The outdoor unit of the refrigeration apparatus according to claim 4, wherein the first seal member and the second seal are pressed against the plural heat transfer tubes and become deformed.

15. The outdoor unit of the refrigeration apparatus according to claim 4, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that side surfaces of the multi-hole flat tubes oppose one another, and the plural fins are made of aluminum or aluminum alloy.

16. The outdoor unit of the refrigeration apparatus according to claim 4, wherein the first seal member and the second seal member include a closed-cell polymer foam.

17. The outdoor unit of the refrigeration apparatus according to claim 5, wherein the plural collection header pipes include a first header collection tube and a second header collection tube that are made of aluminum or aluminum alloy, the plural heat transfer tubes include plural multi-hole flat tubes made of aluminum or aluminum alloy that are connected to the first header collection tube and the second header collection tube between the first and second header collection tubes and are arranged in such a way that side surfaces of the multi-hole flat tubes oppose one another, and the plural fins are made of aluminum or aluminum alloy.

18. The outdoor unit of the refrigeration apparatus according to claim 17, wherein the first seal member and the second seal member include a closed-cell polymer foam.

19. The outdoor unit of the refrigeration apparatus according to claim 1, wherein an inside space of the unit casing is divided by a partition panel to form a first chamber on one side of the partition panel and a second chamber on another side of the partition panel, the heat exchanger being disposed inside the first chamber and the compressor being disposed inside the second chamber.

20. The outdoor unit of the refrigeration apparatus according to claim 19, wherein the first chamber is a blower chamber that encloses the heat exchanger and a fan, and the second chamber is a machine chamber that encloses the compressor and an accumulator.

* * * * *